US011167519B2

(12) United States Patent
Totani

(10) Patent No.: US 11,167,519 B2
(45) Date of Patent: Nov. 9, 2021

(54) PLASTIC BAG AND METHOD FOR MAKING THE SAME

(71) Applicant: Totani Corporation, Kyoto (JP)

(72) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 358 days.

(21) Appl. No.: 16/330,412

(22) PCT Filed: Oct. 13, 2017

(86) PCT No.: PCT/JP2017/037185
§ 371 (c)(1),
(2) Date: Mar. 5, 2019

(87) PCT Pub. No.: WO2018/088117
PCT Pub. Date: May 17, 2018

(65) Prior Publication Data

US 2021/0138757 A1 May 13, 2021

(30) Foreign Application Priority Data

Nov. 8, 2016 (JP) ..... JP2016-218277

(51) Int. Cl.
*B31B 70/26* (2017.01)
*B31B 70/64* (2017.01)
(Continued)

(52) U.S. Cl.
CPC ..... *B31B 70/266* (2017.08); *B31B 70/26* (2017.08); *B31B 70/64* (2017.08); *B65D 31/10* (2013.01);
(Continued)

(58) Field of Classification Search
CPC ..... B31B 70/26; B31B 70/64; B31B 70/266; B31B 2155/002; B65D 33/2508; B65D 31/10
See application file for complete search history.

(56) References Cited

U.S. PATENT DOCUMENTS 6,425,847 B1 * 7/2002 Broenstrup ..... B31B 70/00 493/186
6,561,963 B2 * 5/2003 Totani ..... B65D 31/10 493/189
(Continued)

FOREIGN PATENT DOCUMENTS

JP 2003-300540 10/2003
JP 2004-010055 1/2004
(Continued)

OTHER PUBLICATIONS

International Search Report dated Nov. 14, 2017 in corresponding International patent application No. PCT/JP2017/037185.

*Primary Examiner* — Thomas M Wittenschlaeger
(74) *Attorney, Agent, or Firm* — Kirschstein, Israel, Schiffmiller & Pieroni, P.C.

(57) ABSTRACT

A plastic bag has a safety even when a flap is not adhered on an outer surface of a side gusset. One of the opposite end portions of the side gusset is obliquely folded in half along a fold line and interposed between the two layers of the side gusset, so that the flap is formed by the end portion between the two layers of the side gusset. The flap includes a folded edge formed by a folded inner edge of the side gusset, and an open edge formed by one of the opposite end edges of the side gusset. The flap further includes a joining edge extending straight or curved and joining the folded edge and the open edge on opposite sides of the fold line.

5 Claims, 15 Drawing Sheets

(51) Int. Cl.
*B65D 30/20* (2006.01)
*B65D 33/25* (2006.01)
*B31B 155/00* (2017.01)

(52) U.S. Cl.
CPC .... *B65D 33/2508* (2013.01); *B31B 2155/002* (2017.08)

(56) References Cited

U.S. PATENT DOCUMENTS 6,796,932 B2 * 9/2004 Kuge ..... B65D 31/10 493/189
7,331,917 B2 * 2/2008 Totani ..... B31B 70/00 493/218
7,497,624 B2 * 3/2009 Totani ..... B65D 31/10 383/107
8,414,465 B2 * 4/2013 Totani ..... B65D 31/10 493/243
8,579,779 B2 * 11/2013 Totani ..... B65D 31/08 493/189
8,579,780 B2 * 11/2013 Senbo ..... B31B 50/00 493/189
8,777,826 B2 * 7/2014 Totani ..... B31B 37/00 493/193
10,189,608 B2 * 1/2019 Totani ..... B65D 33/002
10,493,715 B2 * 12/2019 Totani ..... B31B 70/18
10,603,861 B2 * 3/2020 Totani ..... B31B 70/10
2011/0015052 A1 * 1/2011 Totani ..... B65D 33/18 493/189
2011/0039676 A1 * 2/2011 Totani ..... B31B 70/262 493/227
2012/0035035 A1 * 2/2012 Totani ..... B31B 37/00 493/193
2019/0308384 A1 * 10/2019 Totani ..... B31B 70/10

FOREIGN PATENT DOCUMENTS

JP 2004-276933 10/2004
JP 2010-036585 2/2010
JP 2015-187012 10/2015

* cited by examiner

S-S cross section
T-T cross section
S
T
1
2
7
8
11
12
15
32
41

Prior Art

PLASTIC BAG AND METHOD FOR MAKING THE SAME

TECHNICAL FIELD

The present invention relates to a plastic bag and a method for making the same.

BACKGROUND ART

A plastic bag disclosed in Patent documents 1 and 2 includes two sheet panels opposing each other, and a pair of side gussets extending along the opposite side edges of the sheet panels. Each of the side gussets is folded in half and interposed between the sheet panels. The plastic bag can be widened with the side gussets.

To open and close the plastic bag freely, a fastener can be incorporated into the plastic bag. In this case, one end portion of each of the side gussets is obliquely folded in half and interposed between the two layers of the side gusset as disclosed in Patent document 1 or is obliquely folded as it is folded in half as disclosed in Patent document 2.

FIGS. 15A and 15B illustrate an example of a plastic bag according to the prior art. A side gusset 2 is folded in half and interposed between two sheet panels 1 opposing each other to have a folded inner edge 4 and open outer edges 5. One of the opposite end portions of the side gusset 2 is folded in half and interposed between the two layers of the side gusset 2 in the same way as Patent document 1, so that a triangular flap 11 is formed by the end portion between the two layers of the side gusset 2. The flap 11 has a folded edge 13 formed by the folded inner edge 4, and an open edge 14 formed by one of the opposite end edges of the side gusset 2. A sharp corner part of the flap 11 is formed by the folded edge 13 and the outer edge 14.

A first heat sealed part 16 is formed by means of heat sealing the sheet panels 1 and the side gusset 2 to each other along the side edge 3 of the sheet panels 1. A second heat sealed part 17 is formed by means of heat sealing the two layers of the flap 11 to each other along the open edge 14.

The flap 11 projects in a direction away from the plastic bag, when the plastic bag is widened. The corner part of the flap 11 is hard since it is included in the second heat sealed part 17. Therefore, the corner part of the flap 11 can damage other bags or hurt fingers of people. This is undesirable on safety.

To prevent this in Patent document 1, each of the two flaps is adhered on the outer surface of the side gusset with an ultrasonic sealing device. This adhering step is conducted after the heat sealing of parts of the plastic bag and the completion of the shape of the plastic bag. Therefore, a working efficiency is bad. Further, requiring the ultrasonic sealing device can cause increase in cost.

The purpose of one aspect of the present invention is to provide a plastic bag which has high safety even when a flap is not adhered on an outer surface of a side gusset.

CITATION LIST

Patent Literature

Patent document 1: Japanese Laid open Patent application publication JP 2015-187012

Patent document 2: Japanese Patent publication No. 3733085

SUMMARY OF THE INVENTION

According to one aspect of the present invention, there is provided a plastic bag including two sheet panels opposing each other to have opposite side edges, and a pair of side gussets extending along the opposite side edges. Each of the side gussets is folded in half and interposed between the sheet panels to have a folded inner edge, open outer edges, opposite end edges, and opposite end portions. Each of the side gussets further includes a flap between two layers thereof. The flap is formed by one of the opposite end portions which is obliquely folded in half along a fold line and interposed between the two layers. The plastic bag further includes two first heat sealed parts formed by means of heat sealing the sheet panels to the side gussets along the opposite side edges of the sheet panels. The flap includes a folded edge formed by the folded inner edge, an open edge formed by one of the opposite end edges, a second heat sealed part formed by means of heat sealing two layers of the flap to each other along the open edge, and a joining edge extending straight or curved and joining the folded edge and the open edge on opposite side of the fold line.

The second heat sealed part may include a base section extending along the open edge of the flap and a complementary section extending from the base section to the folded edge of the flap. The first heat sealed parts may include main sections extending along the opposite side edges of the sheet panels and protruding sections protruding from the main sections toward an inside of the plastic bag. The complementary section and the protruding sections may be formed opposing each other.

The joining edge may be formed by a cut edge resulting from cutting off a corner part formed by the folded edge and the open edge. Alternatively, the corner part formed by the folded edge and the open edge may be folded in half along an additional fold line and interposed between the two layers of the flap, and the joining edge may be formed by the additional fold line.

According to another aspect of the present invention, there is provided a method for making plastic bags, the method including: intermittently feeding two webs of sheet panels in a continuous direction of the webs of the sheet panels; and cutting off a corner part formed by an inner folded side edge and an end edge of a side gusset folded in half to form a joining edge on the side gusset, the joining edge extending straight or curved and being formed by a cut edge resulting from cutting off the corner part. The method further includes: supplying the side gusset to the webs of the sheet panels and superposing the webs of the sheet panels on each other to interpose the side gusset between the webs of the sheet panels in a perpendicular direction to a feeding direction of the webs of the sheet panels; and before or after the side gusset is interposed between the webs of the sheet panels, obliquely folding an end portion of the side gusset in half and interposing the end portion between two layers of the side gusset to form a flap between the two layers of the side gusset, the flap including the joining edge. The method further includes: heat sealing the webs of the sheet panels to the side gusset in the perpendicular direction and heat sealing two layers of the flap to each other in the perpendicular direction whenever the webs of the sheet panels are intermittently fed; and cutting the webs of the sheet panels and the side gusset along a heat sealed part thereof whenever the webs of the sheet panels are intermittently fed, and thereby successively making the plastic bags.

It is possible to form the flap before or after the side gusset is interposed between the webs of the sheet panels. For example, the method may further includes: temporarily fixing the webs of the sheet panels to the side gusset at the end portion of the side gusset after the side gusset is interposed between the webs of the sheet panels; and then folding one of the webs of the sheet panels in a direction away from the other of the webs of the sheet panels along a continuous fold line extending parallel to the continuous direction of the webs of the sheet panels and folding back the one of the webs of the sheet panels along the continuous fold line to form the flap between the two layers of the side gusset.

A plastic bag according to one aspect of the present invention prevents a flap from damaging other bags or hurting fingers of people even when a flap is not adhered on an outer surface of a side gusset.

EMBODIMENTS

Figure 1A:
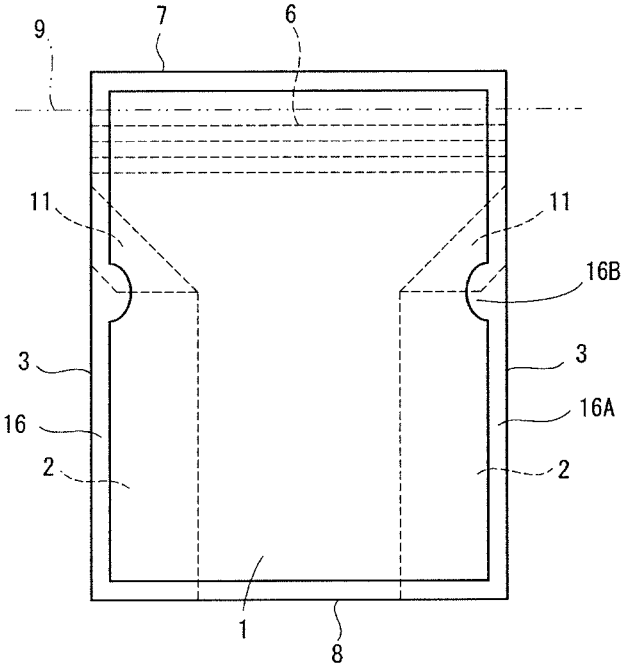
FIG. 1A is a plane view of a plastic bag according to an embodiment of the preset invention.
Figure 1B:
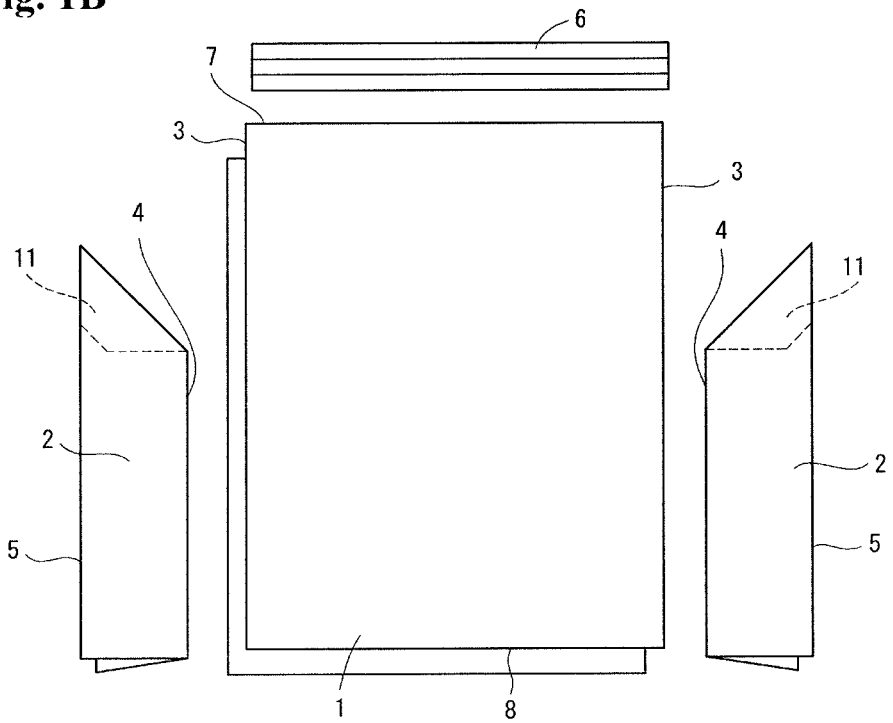
FIG. 1B is an exploded view of the plastic bag.

Hereinafter, a plastic bag according to embodiments of the present invention will be described with reference to accompanying drawings. As illustrated in FIGS. 1A and 1B, a plastic bag includes two sheet panels 1 opposing each other to have the opposite side edges 3, and a pair of side gussets 2. The pair of the side gussets 2 extends along the opposite side edges 3 of the sheet panels 1. Each of the side gussets 2 is folded in half and interposed between the sheet panels 1 to have a folded inner edge 4, open outer edges 5, the opposite ends and the opposite end portions.

The plastic bag further includes a fastener 6. The fastener 6 is interposed between the sheet panels 1 to extend along an end edge 7 of the sheet panels 1. The fastener 6 includes a female member and a male member fitted into the female member. A tape of the female member is heat sealed to one of the sheet panels 1. A tape of the male member is heat sealed to the other of the sheet panels 1. The sheet panels 1 are heat sealed to each other along the opposite end edges 7 and 8 thereof. The plastic bag can be opened and closed with the fastener 6 after the sheet panels 1 are cut along a cut line 9. This is the same as that of Patent document 2.

Figure 2A:
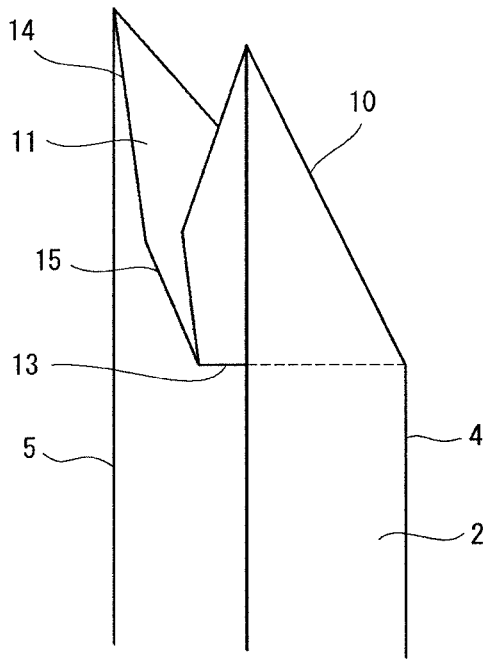
FIGS. 2A and 2B illustrates formation of a flap.
Figure 2B:
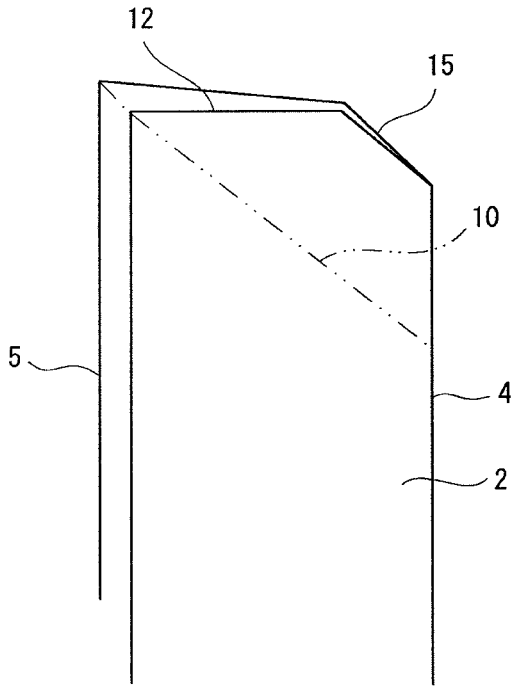
Figure 3:
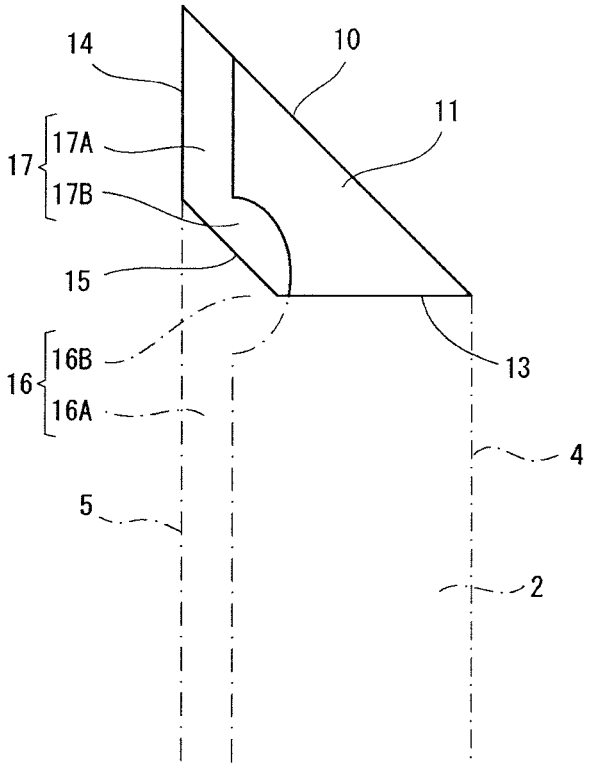
FIG. 3 is a plane view of the flap of a side gusset of FIG. 2A.

As illustrated in FIGS. 2A and 2B, one of the opposite end portions of each of the side gussets 2 is obliquely folded in half along a fold line 10 and interposed between the two layers of the side gusset 2, so that a flap 11 is formed by the end portion between the two layers of the side gusset 2. The fold line 10 is a line segment extending between the folded inner edge 4 and one of the opposite end edges 12 of the side gusset 2. As illustrated in FIGS. 2A, 2B and 3, each of the two flaps 11 includes a folded edge 13 formed by the folded inner edge 4 of the side gusset 2 and extending from one end of the fold line 10, and an open edge 14 formed by the end edge 12 of the side gusset 2 and extending from the other end of the fold line 10.

The fold line 10 is a bisector bisecting an angle between the end edge 12 and the open outer edges 5. The angle between the end edge 12 and the open outer edges 5 is 90°. Thus, the end edge 12 of the side gusset 2 (that is, the open edge 14 of the flap 11) is aligned with the open outer edges 5 of the side gusset 2 when the end portion of the side gusset 2 is obliquely folded along the fold line 10 and interposed between the two layers of the side gusset 2.

The flap 11 further includes a joining edge 15. The joining edge 15 joins the folded edge 13 and the open edge 14 on the opposite side of the fold line 10. In this embodiment, the joining edge 15 extends straight. Further, the joining edge 15 is formed by a cut edge resulting from cutting off the corner part formed by the folded edge 13 and the open edge 14. As illustrated in FIGS. 2A and 2B, to form the joining edge 15, the corner part formed by the end edge 12 and the inner open edge 4 is cut off before the formation of the flap 11, so that the joining edge 15 is formed in advance on the side gusset 2 by the cut edge resulting from cutting off the corner part. Therefore, when the flap 11 is formed, the joining edge 15 is formed on the flap 11.

As illustrated in FIGS. 1A and 1B, the sheet panels 1 are heat sealed to each other along the opposite side edges 3 thereof where the sheet panels 1 exceed the side gussets 2. The sheet panels 1 are heat sealed to the side gussets 2 along the opposite side edges 3. Therefore, two first heat sealed parts 16 are formed by means of this heat sealing. The first heat sealed parts 16 prevent leakage between the sheet panels 1 and the side gussets 2. In this embodiment, the first heat sealed parts 16 include main sections 16A extending along the opposite side edges 3 and each having a constant width, and protruding sections 16B protruding from the main sections 16A toward the inside of the plastic bag. The protruding sections 16B restrain the end portion of each of the side gussets 2 and the flaps 11 from projecting in a direction away from the plastic bag when the plastic bag is widened. This is the same as that of Japanese Patent publication No. 4806565.

As illustrated in FIG. 3, the two layers of each of the two flaps 11 are heat sealed to each other along the open edge 14. Therefore, a second heat sealed part 17 is formed by means of this heat sealing. The second heat sealed part 17 prevents leakage between the two layers of the flap 11. In this embodiment, the second heat sealed part 17 of each of the flaps 11 includes a base section 17A having a constant width and extending along the open edge 14, and a complementary section 17B extending from the base section 17A to the folded edge 13. The complementary section 17B prevents leakage between the two layers of the flap 11 through the joining edge 15. If the base section 17A has a constant width such that it reaches the folded edge 13, the complementary section 17B does not have to be provided, since the base section 17A securely prevents the leakage between the two layers of the flap 11. The fold line 10 does not have to bisect the angle of the end edge 12 and the outer open side edges 5 as long as the second heat sealed part 17 reaches the folded edge 13 to assure the sealability. This means that the angle of the fold line 10 and the outer open edges 5 does not have to be 45°, and that the open edge 14 and the joining edge 15 only have to be included in the second heat sealed part 17.

In this plastic bag, the inner surfaces of the sheet panels 1 are made of sealant such as polyethylene, polypropylene, whereas the outer surfaces of the sheet panels 1 are made of base material such as nylon. The inner surfaces of the side gussets 2 are made of the sealant, whereas the outer surfaces of the side gussets 2 are made of the base material. Therefore, the inner surfaces of the flaps 11 are made of the sealant, whereas the outer surfaces of the flaps 11 are made of the base material.

Therefore, when the sheet panels 1, the side gusset 2 and the flap 11 are clamped with a pair of the heat seal bars, heated and pressured with the heat seal bars, and thereby heat sealed along one or the other of the opposite side edges 3, the sheet panels 1 and the side gusset 2 are heat sealed to each other with the sealant, so that the first heat sealed part 16 is formed. At the same time, the two layers of the flap 11 are heat sealed to each other with the sealant, so that the second heat sealed part 17 is formed. On the other hand, the side gusset 2 and the flap 11 are not heat sealed to each other, since the outer surfaces of both the side gusset 2 and the flap 11 are made of the base material.

At least one of the heat seal bars preferably includes a bar part extending with a constant width, and a wide part protruding from one of the opposite side edges of the bar part in the width direction of the bar part. When the sheet panels 1, the side gusset 2 and the flap 11 are heat sealed along one or the other of the opposite side edges 3 with the pair of the heat seal bars to form the first heat sealed part 16 and the second heat sealed part 17, the main sections 16A and the base section 17A are formed with the bar part whereas the protruding sections 16B and the complementary section 17B are formed with the wide part. It is, therefore, possible to form the protruding sections 16B and the complementary section 17B at the same time. In this case, the complementary section 17B and the protruding sections 16B are formed opposing each other in an area located by one/the other of the edges 3 of the sheet panels 1.

Figure 4:
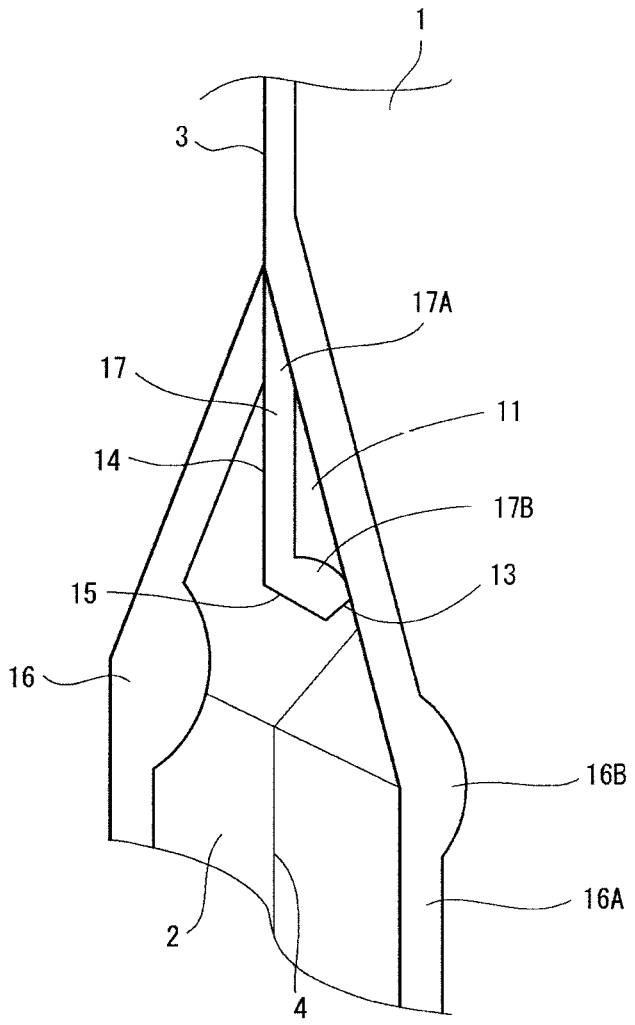
FIG. 4 is a partial perspective view of the plastic bag widened of FIG. 1.

As illustrated in FIG. 4, the plastic bag can be widened with the side gussets 2 to increase its capacity. The flaps 11 project in a direction away from the plastic bag when the plastic bag is widened. As described above, the corner part of the flap 11 formed by the folded edge 13 and the open edge 14 is cut off, so that the joining edge 5 extending straight is formed. Therefore, even when the flaps 11 project in the direction away from the plastic bag, the flaps 11 do not damage other bags or hurt fingers of people, which ensures the safety. The flaps 11 of the plastic bag disclosed in Patent document 1 are adhered on the side gussets with the ultrasonic device to ensure the safety, whereas the plastic bag according to the embodiment of the present invention eliminates the need for this.

Figure 5A:
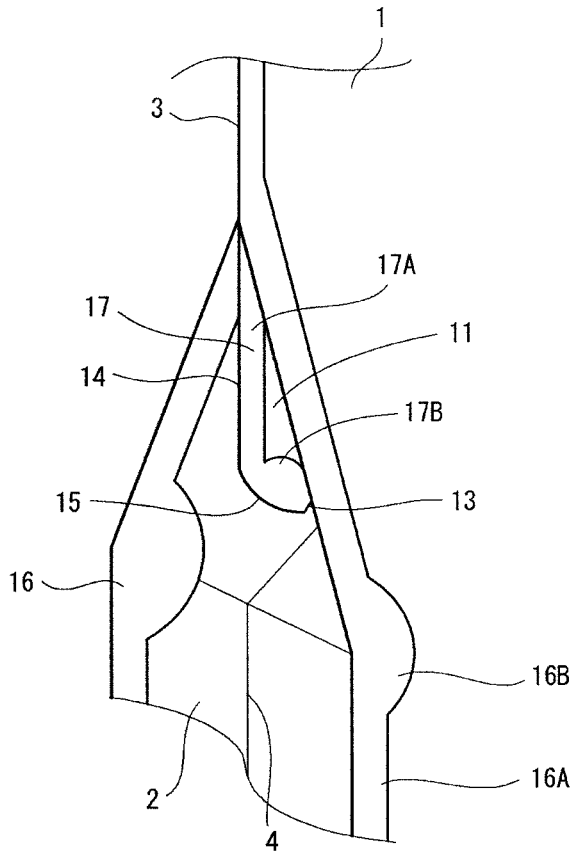
FIG. 5A is a partial perspective view of a plastic bag widened according to another embodiment of the present invention.
Figure 5B:
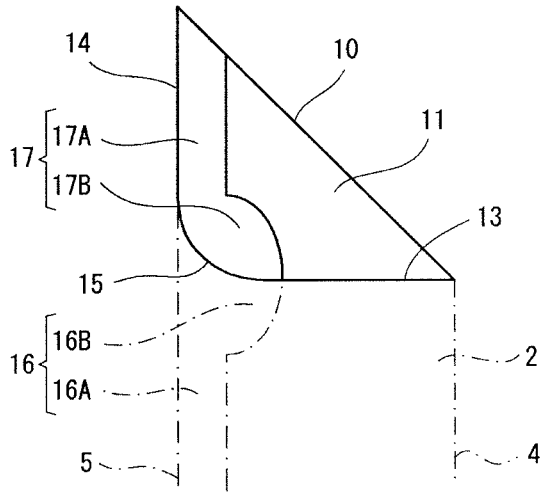
FIG. 5B is a plane view of a flap of the plastic bag of FIG. 5A.

In an embodiment illustrating FIG. 5, the joining edge 15 of each of the flaps 11 extends curved instead of extending straight. In other words, the joining edge 15 of the embodiment of FIG. 5 is a curved line projecting in a direction away from the fold line 10, whereas the joining line 15 of the embodiment of FIG. 1 is a straight line. Like the plastic bag of FIG. 1, the joining edge 15 of FIG. 5 is formed by the cut edge resulting from cutting off the corner part formed by the folded edge 13 and the open edge 14. It is clearly appreciated that the plastic bag of FIG. 5 also ensures the safety like that of FIG. 1.

Figure 6:
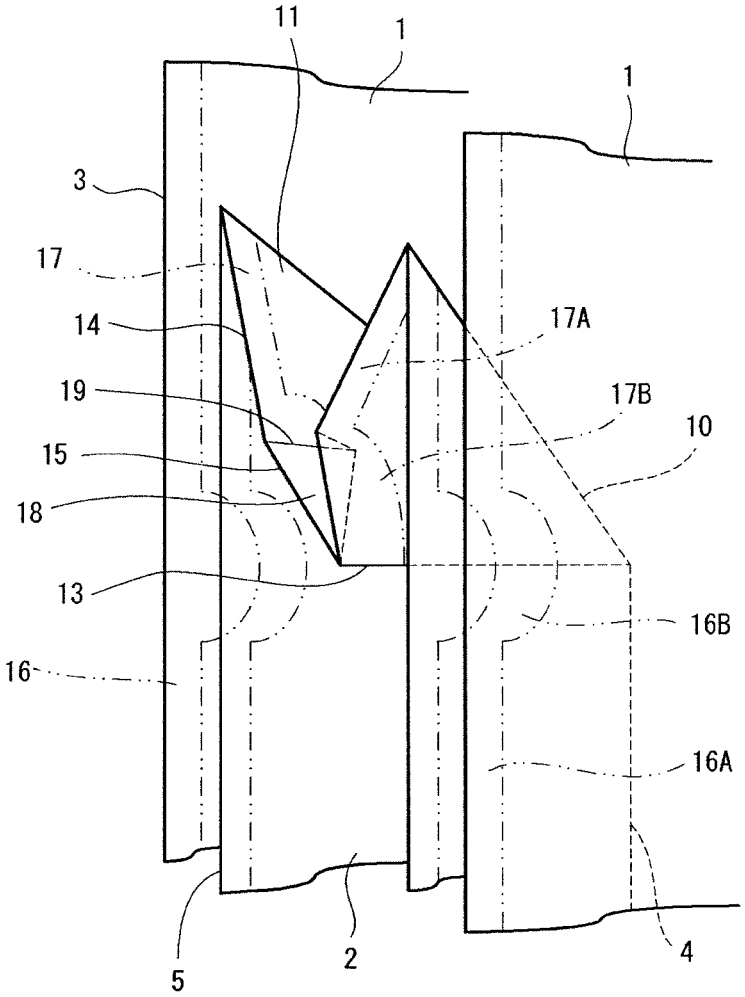
FIG. 6 is an exploded view of a plastic bag according to a further embodiment.

In an embodiment illustrated in FIG. 6, the corner part of each of the flaps 11 formed by the folded edge 13 and the open edge 14 is not cut off. The corner part is folded in half along an additional fold line and interposed between the two layers of the flap 11, so that a folded piece 18 is formed by the corner part between the two layers of the flap 11. The joining edge 15 of the flap 11 extending straight is formed by the additional fold line.

Since the inner surface of the folded piece 18 is made of the base material, the two layers of the folded piece 18 are not heat sealed to each other. Therefore, leakage can occur through an open edge 19 of the folded piece 18. To prevent this in the embodiment, the whole of the folded piece 18 is positioned within the second heat sealed part 17 which includes the base section 17A and the complementary section 17B, and thus the two layers of the flap 11 are heat sealed to each other along the folded piece 18. The complementary section 17B does not have to be provided, if the base section 17A has a constant width such that the whole of the folded piece 18 is positioned within the base section 17A. This plastic bag also ensures the safety like that of FIG. 1.

Figure 7A:
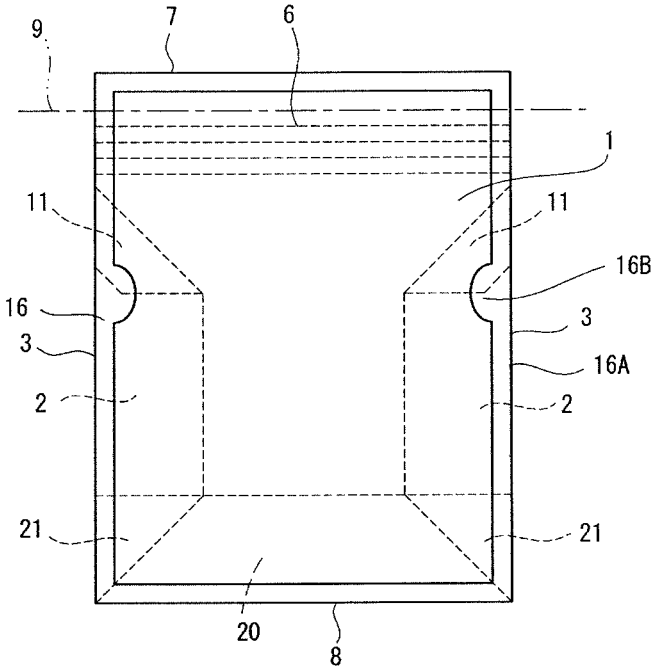
FIG. 7A is a plane view of a plastic bag according to a further embodiment.
Figure 7B:
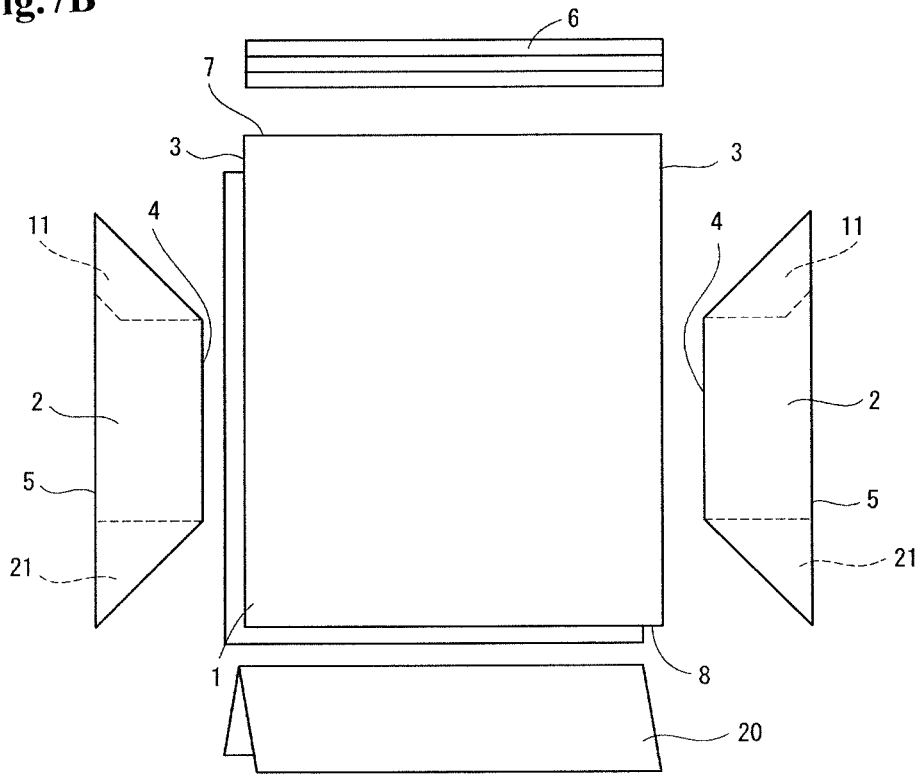
FIG. 7B is an exploded view of the plastic bag of FIG. 7A.

As illustrated in FIGS. 7A and 7B, a bottom gusset 20 may be incorporated into the plastic bag. In this embodiment, the other end portion of each of the side gussets 2 is folded in half and interposed between the two layers of the side gusset 2, so that an auxiliary gusset 21 is formed between two layers of the side gusset 2. The bottom gusset 20 is folded in half and interposed between the sheet panels 1 and between the two layers of the respective auxiliary gussets 2. The auxiliary gussets 21 and the bottom gusset 20 are heat sealed to each other along the opposite side edges 3 of the sheet panels 1. The sheet panels 1 and the bottom gusset 20 are heat sealed to each other along the other of the opposite end edges 8 of the sheet panels 1. Therefore, when the plastic bag is widened, the bottom gusset 20 forms a flat base which allows the plastic bag to stand upright. Like the sheet panels 1 and the side gussets 2, the inner surface of the bottom gusset 20 is made of the sealant such as polyethylene, polypropylene, whereas the outer surface of the bottom gusset 20 is made of the base material such as nylon. This is same as that of Patent document 2.

Figure 8:
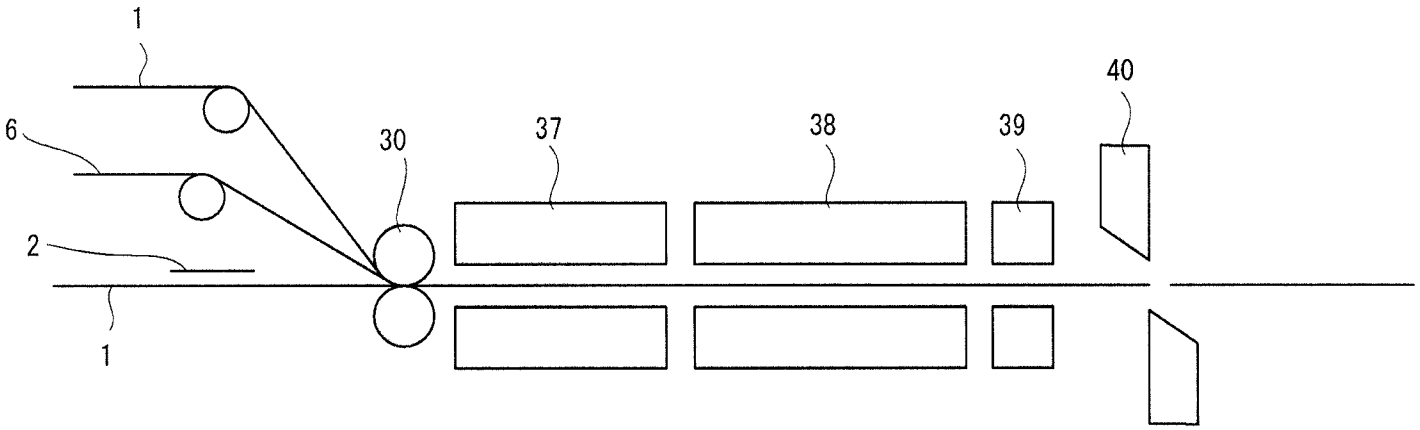
FIG. 8 is a side view of an apparatus for making plastic bags.
Figure 9:
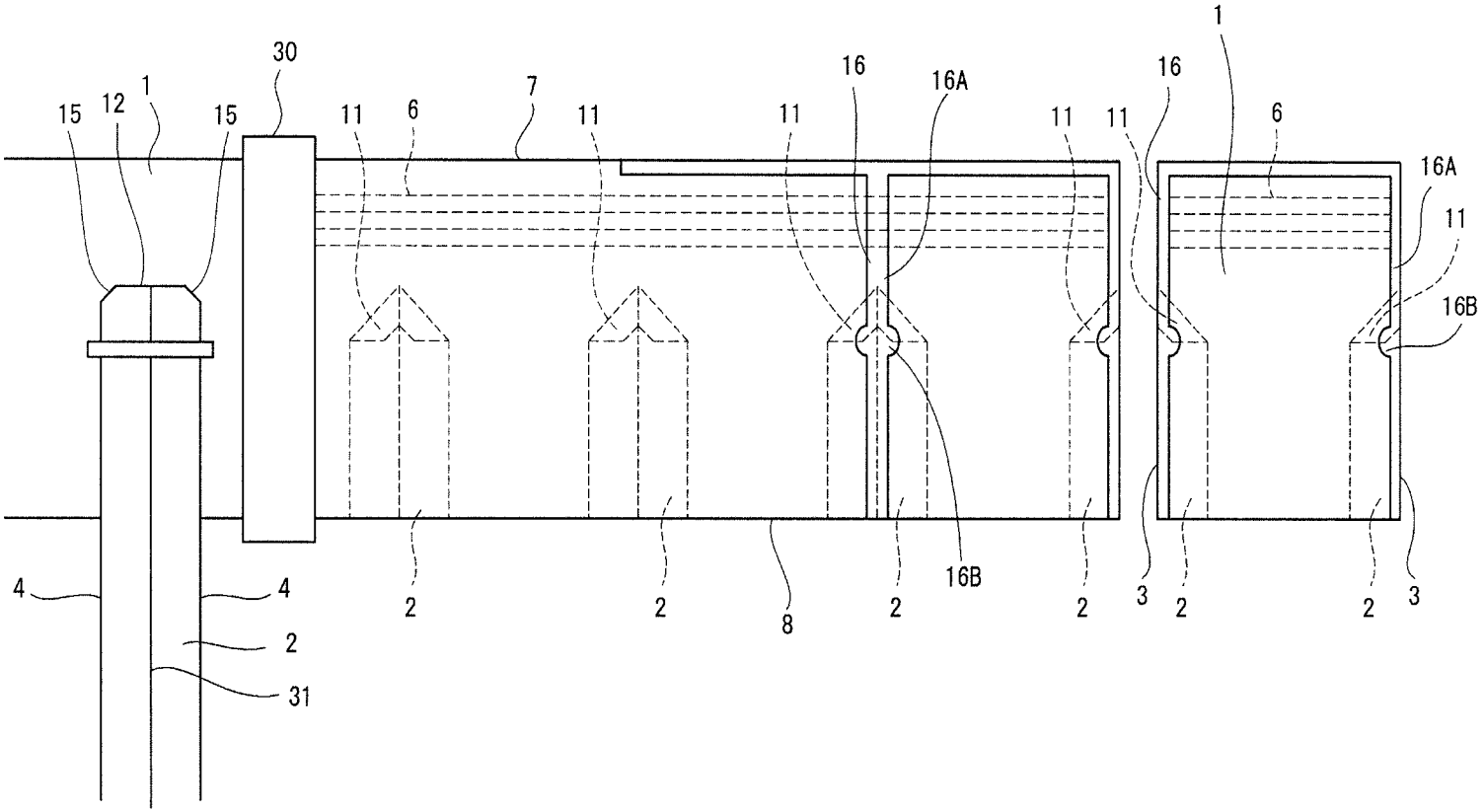
FIG. 9 illustrates a method for making plastic bags according to an embodiment of the present invention.

A method for making plastic bags according to an embodiment of the present invention will be described. FIG. 8 illustrates an example of a plastic bag making apparatus for successively making the plastic bags. The apparatus is provided with feed rollers 30, which serve as a sheet panel feed device. Two webs of sheet panels 1 are directed to the feed rollers 30, superposed on each other and intermittently fed by the feed rollers 30. As illustrated in FIG. 9, each of the webs of the sheet panels 1 includes the sheet panels of the plastic bags to be made continuous in the width direction of the sheet panels. The feeding direction of the webs of the sheet panels 1 is the continuous direction thereof.

Whenever the webs of the sheet panels 1 are intermittently fed, the side gusset 2 is supplied to the webs of the sheet panels 1 to be disposed in a perpendicular direction to the feeding direction of the webs of the sheet panels 1. The side gusset 2 of this embodiment is a web of a side gusset having a double width of the side gusset of the plastic bag to be made. Before the side gusset 2 is supplied to the webs of the sheet panels 1, the side gusset 2 is folded in halves on the opposite sides with respect to the longitudinal centerline 31 thereof to have a pair of the inner folded lines 4. Whenever the webs of the sheet panels 1 are intermittently fed, the side gusset 2 is fed intermittently by a side gusset supplying device such as a conveyor belt in the perpendicular direction to the feeding direction of the webs of the sheet panels 1 to be disposed on one of the webs of the sheet panels 1 in the perpendicular direction. The web of the side gusset 2 includes the side gussets of the plastic bags to be made continuous in the longitudinal direction of the side gussets. The feeding direction of the web of the side gusset 2 is the continuous direction thereof.

Figure 10:
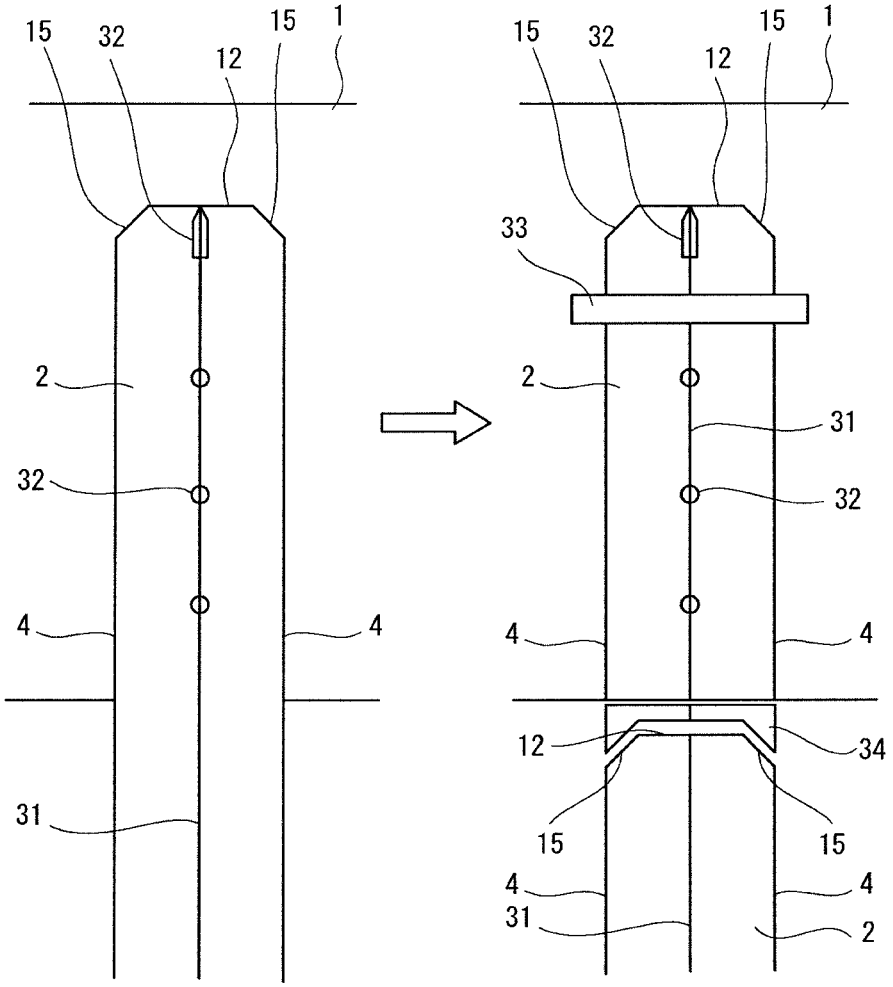
FIG. 10 illustrates a processing step of a side gusset.

As illustrated in FIG. 10, two corner parts formed by the inner folded edges 4 and the end edge 12 of the side gusset 2 are cut off, so that two joining edges 15 are formed by the cut edges resulting from cutting off the corner parts. The joining edges 15 are formed on the widthwise opposite sides of the side gusset 2. FIG. 10 illustrates the joining edges 15 extending straight for making the plastic bags of FIG. 1. When the plastic bags illustrated in FIG. 5 are made, the joining edges 15 extending curved are formed on the side gusset 2.

After the supply of the side gusset 2, the side gusset 2 and the webs of the sheet panels 1 are spot sealed by the heat seal device or ultrasonic seal device on the longitudinal centerline 31 of the side gusset 2 to be temporarily fixed to each other, so that the spot heat sealed parts 32 are formed. At least one of the spot heat sealed parts 23 is formed at the end portion of the side gusset 2.

Then, the press bar 33 is put on the side gusset 2 to press the side gusset 2 on one of the webs of the sheet panels 1. The web of the side gusset 2 is cut by the cut device (including such as a cutter) so as to obtain a side gusset of the plastic bag therefrom. At the same time or after this cutting, the two corner parts of the web of the side gusset 2 formed by a new end edge 12 and the inner folded edges 4 are cut off, so that new two joining edges 15 are formed on the web of the side gusset 2. In this embodiment, the web of the side gusset 2 is punched, for example by a Tomson blade, in such a manner that the web of the side gusset 2 are cut and that at the same time the corner parts are cut off. As illustrated in FIG. 10, it is preferable in view of collecting the margins that the web of the side gusset 2 is punched in such a manner that only one margin 34 generates which includes the two opposite corner parts and a connecting part connecting the two opposite corner parts.

Figure 11A:
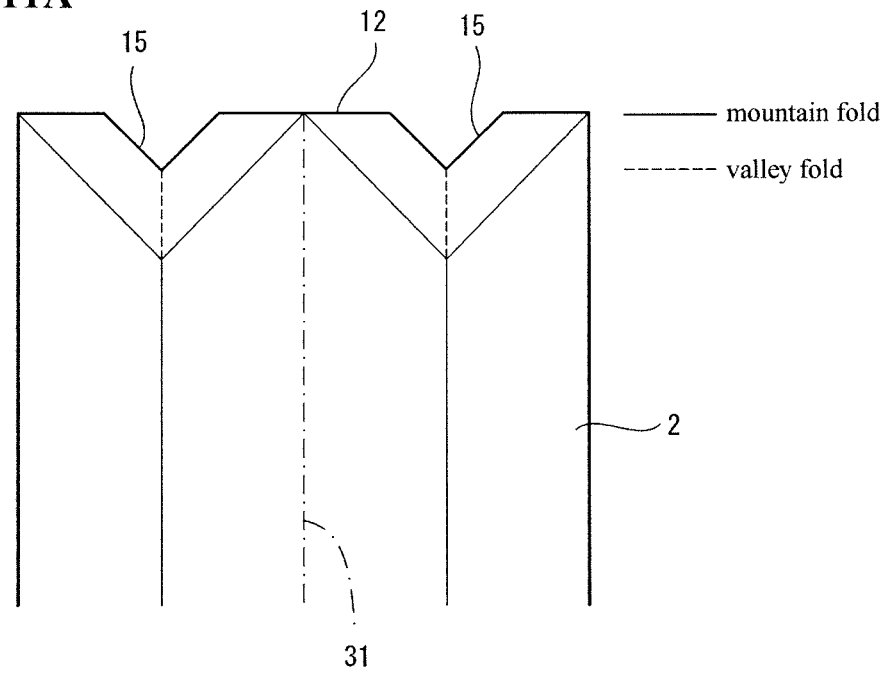
FIGS. 11A and 11B illustrate a processing step of a side gusset.
Figure 11B:
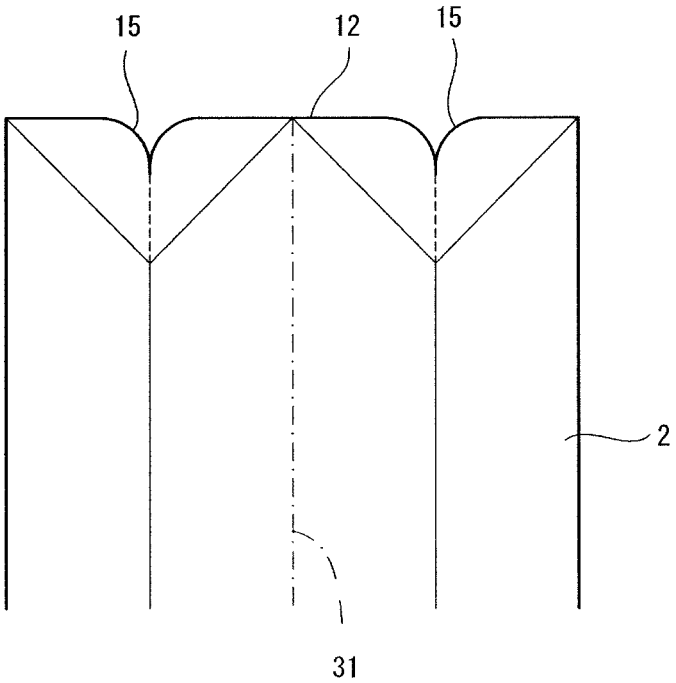

The corner parts may be cut off before the side gusset 2 is folded in halve on the opposite sides with respect to the longitudinal centerline 31. In embodiments illustrated in FIGS. 11A and 11B, before the side gusset 2 is folded in halves, the end edge 12 of the side gusset 2 is notched at the two half-fold lines. For making the plastic bags of FIG. 1, the end edge 12 is notched in V-shape (FIG. 11A). For making the plastic bags of FIG. 5, the end edge 12 is notched in curved V-shape (FIG. 11B). When the side gusset 2 is folded in halves on the opposite sides with respect to the longitudinal centerline 31, the joining edges 15 are formed on the widthwise opposite sides of the side gusset 2.

Figure 12B:
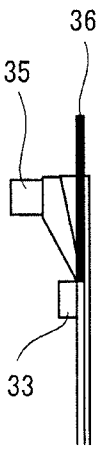
FIG. 12B is a side view of a flap forming device.
Figure 12A:
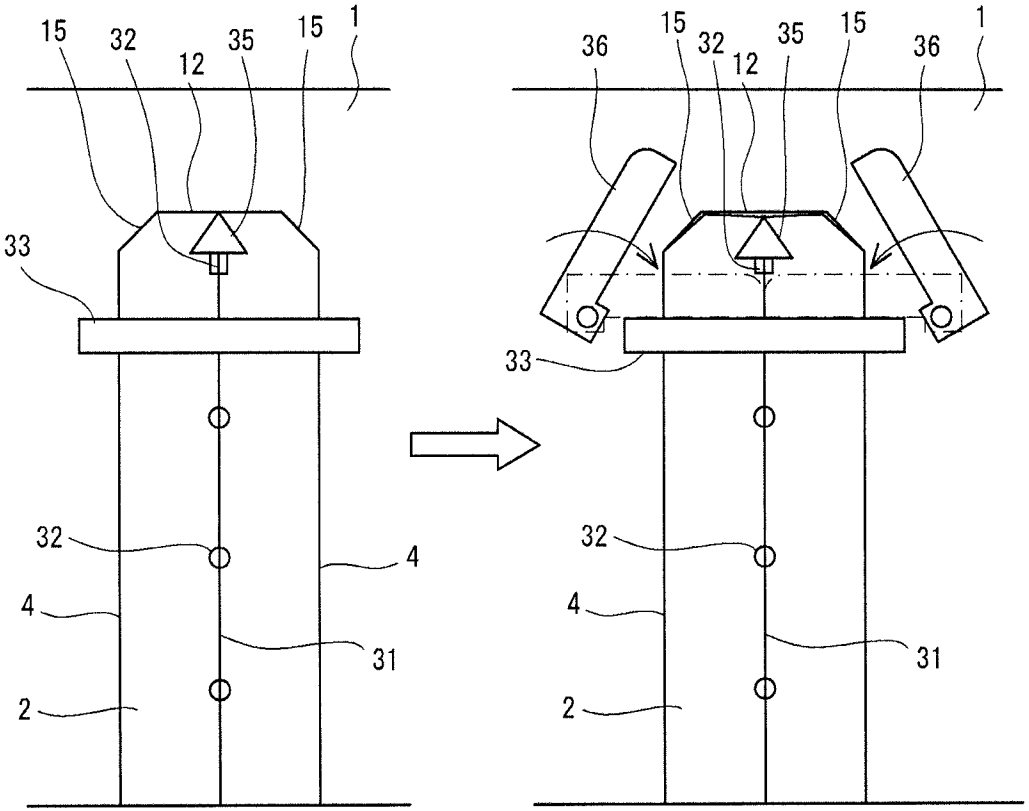
FIG. 12A illustrates formation of a flap.

As illustrated in FIGS. 12A and 12B, the end portion of the side gusset 2 is folded in halves and interposed between the two layers of the side gusset 2 by the side gusset folding device, so that two flaps 11 are formed by the end portion between the two layers of the side gusset 2. As illustrated in FIG. 12B, the side gusset folding device of this embodiment includes the press bar 33, a suction head 35 and a pair of spatulas 36. The press bar 33 having a bar shape is put on the side gusset 2 across the side gusset 2 in a direction parallel to the width direction of the side gusset 2 to press the side gusset 2 on one of the webs of the side gussets 1.

The suction head 35 moves to the end portion of the side gusset 2 to face one of the two layers of the side gusset 2. The suction head 35 sucks the one of the two layers of the side gusset 2 to pull this up. Since the other of the two layers of the side gusset 2 is temporarily fixed to the one of the webs of the sheet panels 1 with the spot sealed part 32 at the end portion of the side gusset 2, the end portion of the side gusset 2 is expanded when the one of the two layers of the side gusset 2 is pulled up.

Figure 13:
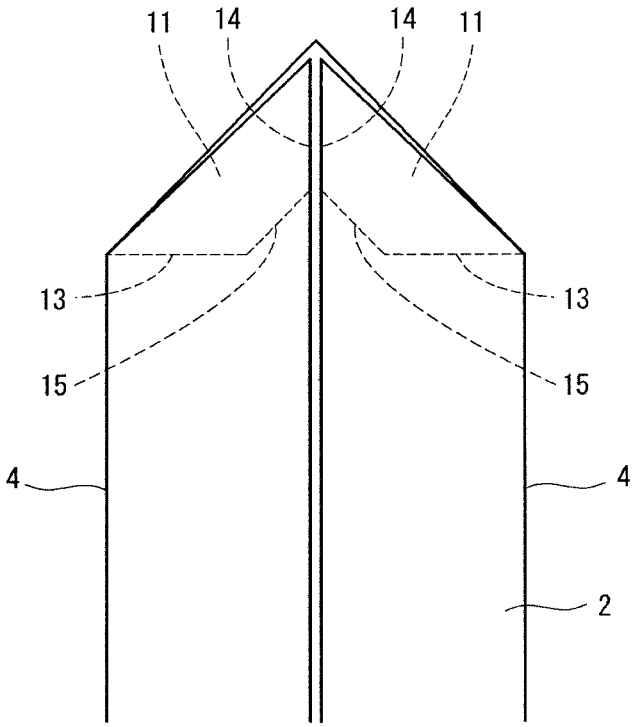
FIG. 13 is a plane view of a side gusset.

The pair of the spatulas 36 moves to the end portion of the side gusset 2 to face the widthwise opposite sides of the side gusset 2. After the end portion of the side gusset 2 is expanded by the press bar 33 and the suction head 35, each of the spatulas 36 rotates around an axis perpendicular to a plane of the side gusset 2 toward the end portion of the side gusset 2 to the press bar 33 (see the dotted line of FIG. 12A). This causes the spatulas 36 to be inserted between the two layers of the side gusset 2, and then the end portion of the side gusset 2 to be obliquely folded in halves by the spatulas 36 and interposed between the two layers of the side gusset 2. As a result, two flaps 11 are formed by the end portion and interposed between the two layers of the side gusset 2 as illustrated in FIG. 13. Each of the flaps 11 has the folded edge 13, the open edge 14 and the joining edge 15.

In the embodiment above, the joining edges 15 are not formed 1 by means of cutting off the corner parts of the flaps 11 after the formation of flaps 11. The joining edges 15 are formed on the flap 11 in such a manner that they are formed on the side gusset 2 in advance before the formation of the flaps 11. The flaps 11 may be formed before the side gusset 2 is supplied to the webs of the sheet panels 1.

Then, the two webs of the sheet panels 1 are superposed on each other at the feeding rollers 30, so that the side gusset 2 is interposed between the webs of the sheet panels 1 in the perpendicular direction to the feeding direction of the webs of the sheet panels 1. At the same time, the fastener 6 is inserted between the webs of the sheet panels 1. The fastener 6 is a web of a fastener to be continuously fed in the longitudinal direction.

Then, the webs of the sheet panels 1 and the fastener 6 are heat sealed to each other by the heat seal device 37 whenever the webs of the sheet panels 1 are intermittently fed. The webs of the sheet panels 1 are heat sealed to each other along one end edge 7 thereof by a heat seal device 38. The webs of the sheet panels 1 are heat sealed to each other along the other end edge 8 thereof in the later step after filling of contents.

The webs of the sheet panels 1, the side gusset 2, and the flaps 11 are heat sealed by the heat seal device 39 along the longitudinal centerline 31 of the side gusset 2 whenever the webs of the sheet panels 1 are intermittently fed. Therefore, the webs of the sheet panels 1 are heat sealed to each other in the perpendicular direction to the feeding direction thereof where the webs of the sheet panels 1 exceed the side gusset 2, and heat sealed to the side gusset 2 in the perpendicular direction to the feeding direction thereof, so that the first heat sealed part 16 is formed. At the same time, the two layers of each of the two flaps 11 are heat sealed to each other in the perpendicular direction to the feeding direction of the webs of the sheet panels 1, so that the second heat sealed part 17 (FIG. 3 etc.) of each of the two flaps 11 is formed.

The heat seal device 39 of this embodiment includes the heat seal bar. The heat seal bar includes a bar part extending in the perpendicular direction to the feeding direction of the webs of the sheet panels 1 and two wide parts, one of which protrudes from one of the opposite side edges of the bar part in the width direction of the bar part and the other of which protrudes from the other of the opposite side edges of the bar part in the width direction of the bar part. When the first heat sealed part 16 and the second heat sealed parts 17 (of the side gusset 2) are formed with the heat seal bar at the same time, the main sections 16A and the base sections 17A are formed with the bar part, and the protruding sections 16B and the complementary sections 17B are formed with the wide parts.

Then, the webs of the sheet panels 1, the side gusset 2, and the web of the fastener 6 are cut along the longitudinal centerline 31 of the side gusset 2 by the cut device 40 including such as a cutter whenever the webs of the sheet panels 1 are intermittently fed. Therefore, the webs of the sheet panels 1, the side gusset 2, and the web of the fastener 6 are cut along the first heat sealed part 16. And the opposing side edges 3 of the sheet panels 1 are formed by the cut edges resulting from this cutting.

Thereby, the plastic bags of FIG. 1 or FIG. 5 are successively made.

In the above embodiment, the flaps 11 are formed before the side gusset 2 is interposed between the webs of the sheet panels 1. In an embodiment illustrated in FIGS. 14A-C, the flaps 11 are formed after the side gusset 2 is interposed between the webs of the sheet panels 1 in the same way disclosed in Japanese Patent publication No. 3655627.

Figures 14A, 14B, 14C:
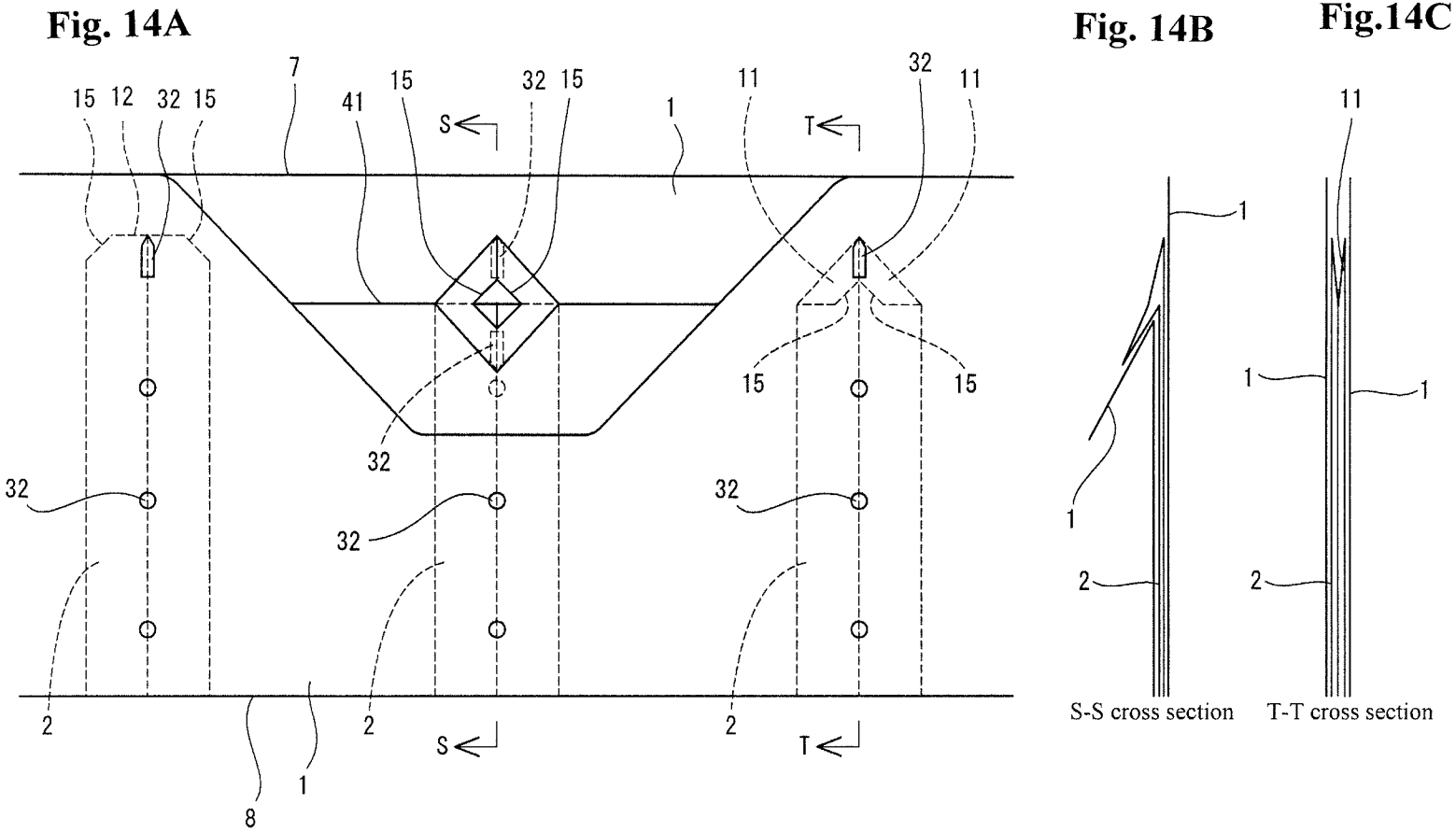
FIG. 14A illustrates formation of a flap according to another embodiment.
FIG. 14B is a cross sectional view taken along the line S-S of FIG. 14A.
FIG. 14C is a cross sectional view taken along the line T-T of FIG. 14A.
Figure 15A:
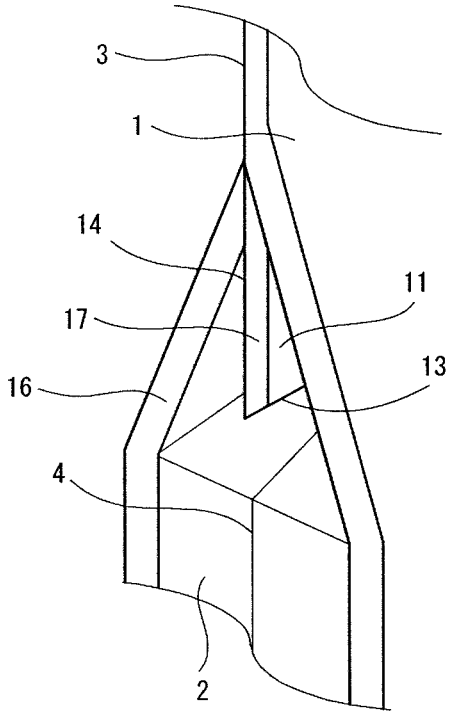
FIG. 15A is a partial perspective view of a plastic bag widened according to a prior art.
Figure 15B:
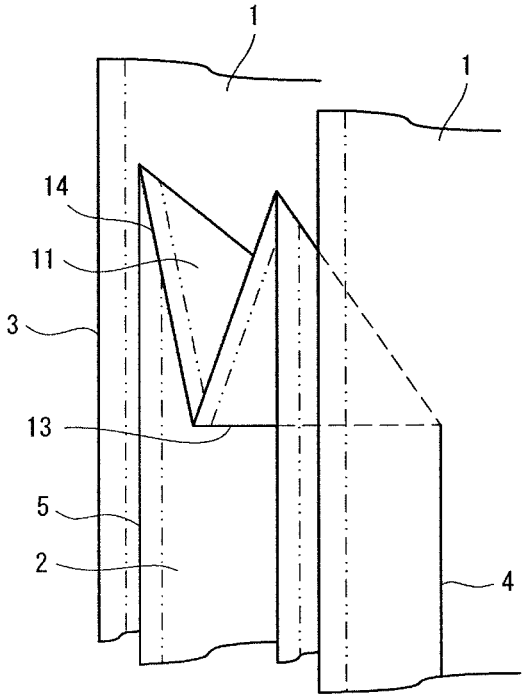
Prior Art Fig.15B
FIG. 15B is an exploded view of the plastic bag of FIG. 15A.

As illustrated in FIGS. 14A-14C, after the side gusset 2 is interposed between the webs of the sheet panels 1, the side gusset 2 and the webs of the sheet panels 1 are spot sealed by the heat seal device or ultrasonic device at at least the end position of the side gusset 2 to be temporarily fixed to each other, so that at least one sealed part 32 (in this embodiment several sealed parts) is formed. With the spot heat sealed part 32, one of the webs of the sheet panels 1 and one of the two layers of the side gusset 2 are temporarily fixed to each other, and the other of the webs of the sheet panels 1 and the other of the two layers of the side gusset 2 are heat sealed to each other.

Then, as the webs of the sheet panels 1 are fed, one of the webs of the sheet panels 1 is guided by the well-known guide device to be folded along a continuous fold line 41 extending parallel to the continuous direction of the webs of sheet panels 1 and close to the end edge 7. The folding direction of the one of the webs of the sheet panels 1 is a direction away from the other of the webs of the sheet panels 1. The cross section at this time is illustrated in FIG. 14B, which is a cross sectional view taken along S-S line of FIG. 14A. Then, as the webs of the sheet panels 1 are fed, the one of the webs of the sheet panels 1 is further guided by the guide device to be folded back along the continuous fold line 41. The cross section at this time is illustrated in FIG. 14C, which is across sectional view taken along T-T line of FIG. 14A. When the one of the webs of the sheet panels 1 is folded and then folded back, one of the two layers of the end portion of the side gusset 2 is also folded and then folded back along the fold continuous line 41 due to temporarily fixing the webs of the sheet panels 1 and the side gusset 2 to each other. Thereby, the end portion of the side gusset 2 is obliquely folded in halves and interposed between the two layers of the side gusset 2, so that the two flaps 11 are formed by the end portion between the two layers of the side gusset 2.

Although the foregoing description is directed to the preferred embodiments of the present invention, it is noted that other variations and modifications will be apparent to those skilled in the art, and may be made without departing from the spirit or scope of the invention.

EXPLANATIONS OF LETTERS OR NUMERALS

1 sheet panel/web of sheet panel
2 side gusset/web of side gusset
3 side edge
4 inner folded edge
5 outer open edge
10 fold line
11 flap
12 end edge
13 folded edge
14 open edge
15 joining edge
16 first heat sealed part
16A main section
16B protruding section
17 second heat sealed part
17A base section
17B complementary section

The invention claimed is:

1. A plastic bag comprising:

two sheet panels opposing each other to have opposite side edges;

a pair of side gussets extending along the opposite side edges, each of the side gussets being folded in half and interposed between the sheet panels to have a folded inner edge, open outer edges, opposite end edges, and opposite end portions, each of the side gussets further including a flap between two layers thereof, the flap being formed by one of the opposite end portions which is obliquely folded in half along a fold line and interposed between the two layers; and two first heat sealed parts in which the sheet panels are heat sealed to the side gussets along the opposite side edges of the sheet panels, the flap including:

a folded edge formed by the folded inner edge;

an open edge formed by one of the opposite end edges and aligned with the open outer edges;

a second heat sealed part in which two layers of the flap are heat sealed to each other along the open edge; and a joining edge extending straight or curved and joining the folded edge and the open edge on opposite side of the fold line, the first heat sealed parts including:

main sections extending along the opposite side edges of the sheet panels; and protruding sections protruding from the main sections toward an inside of the plastic bag, the second heat sealed part including:

a base section extending along the open edge; and a complementary section extending from the base section to the folded edge, wherein the open edge and the joining edge are included in the second heat sealed part, and wherein the complementary section and the protruding sections are formed opposing each other.

2. The plastic bag according to claim 1, wherein the joining edge is a curved line projecting in a direction away from the fold line.

3. The plastic bag according to claim 1, wherein inner surfaces of the sheet panels, inner surfaces of the side gussets, and an inner surface of the flap are made of sealant, and wherein outer surfaces of the sheet panels, outer surfaces of the side gussets, and an outer surface of the flap are made of base material.

4. The plastic bag according to claim 1, wherein the joining edge is formed by a cut edge resulting from cutting off a corner part of the flap formed by the folded edge and the open edge.

5. The plastic bag according to claim 1, wherein a corner part of the flap formed by the folded edge and the open edge is folded in half along an additional fold line and interposed between two layers of the flap, and the joining edge is formed by the additional fold line.

* * * * *